US008215982B2

(12) United States Patent
Bu et al.

(10) Patent No.: US 8,215,982 B2
(45) Date of Patent: Jul. 10, 2012

(54) ELECTRICAL CONNECTOR HAVING RELIABLE CONNECTION BETWEEN LED DEVICES AND PRINTED CIRCUIT BOARD

(75) Inventors: Jian-Ming Bu, Kunshan (CN); Zheng-Hua Xu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 412 days.

(21) Appl. No.: 12/536,494

(22) Filed: Aug. 6, 2009

(65) Prior Publication Data

US 2010/0124842 A1 May 20, 2010

(51) Int. Cl.
*H01R 3/00* (2006.01)

(52) U.S. Cl. ..... 439/490; 439/541.5

(58) Field of Classification Search ..... 439/541.5, 439/490

See application file for complete search history.

(56) References Cited

U.S. PATENT DOCUMENTS

| | | | | |
|---|---|---|---|---|
| 6,655,988 | B1 * | 12/2003 | Simmons et al. | 439/541.5 |
| 6,688,909 | B1 * | 2/2004 | Espenshade et al. | 439/490 |
| 6,688,914 | B1 * | 2/2004 | Espenshade et al. | 439/541.5 |
| 6,729,906 | B1 * | 5/2004 | Simmons et al. | 439/607.26 |
| 7,125,280 | B1 * | 10/2006 | Lee et al. | 439/490 |
| 7,241,181 | B2 * | 7/2007 | Machado et al. | 439/676 |

* cited by examiner

*Primary Examiner* — Tulsidas C Patel
*Assistant Examiner* — Travis Chambers
(74) *Attorney, Agent, or Firm* — Ming Chieh Chang; Wei Te Chung; Andrew C. Cheng

(57) ABSTRACT

An electrical connector (100) mounted on a printed circuit board (200), the electrical connector includes an insulative housing (1) having a number of conductive members (32) and a LED device (2) disposed therein. Each conductive member includes a conductive pad (321) electrically connected with the printed circuit board. The LED device includes a LED (21) and a number of tail portions (221, 222) electrically interconnected with the LED. The tail portions are soldered on the conductive pads of the conductive members.

20 Claims, 5 Drawing Sheets

ELECTRICAL CONNECTOR HAVING RELIABLE CONNECTION BETWEEN LED DEVICES AND PRINTED CIRCUIT BOARD

BACKGROUND OF THE INVENTION

1. Field of the Invention

The present invention relates to an electrical connector, and more particularly to an electrical connector having a LED (Light-Emitting Diodes) device connecting with a plurality of electrical leads for transmitting light signal from a printed circuit board.

2. Description of the Prior Art

U.S. Pat. No. 6,655,988 issued to Simmons on Dec. 2, 2003 discloses a stacked jack modular jack assembly comprising a multi-port housing, a plurality of LED devices and electrical leads received in the housing. Each LED device includes a LED and a plurality of tail portions interconnected with the LED. The conductive contacts are secured in a carrier member. Each electrical lead includes a termination section formed on a top surface of the carrier member, and a lead section formed on a bottom surface of the carrier member for electrically connecting with the printed circuit board. The termination sections simulate an insulation displacement contact (IDC) portion to receive the tail portions of the LED device. However, the engagement between the tail portions of the LED device and the termination sections of the electrical leads is unreliable. That would result in an unreliable connection between the LED device and the printed circuit board, and there maybe indicate an error in transmitting the light signal.

Hence, an improved electrical connector having reliable connection between LED devices and printed circuit board is needed to solve the above problem.

BRIEF SUMMARY OF THE INVENTION

One object of the present invention is to provide an electrical connector having a reliable connection between LED devices and printed circuit board.

In order to achieve the object set forth, an electrical connector mounted on a printed circuit board, the electrical connector includes an insulative housing having a plurality of conductive members and a LED device disposed therein. Each conductive member includes a conductive pads electrically connected with the printed circuit board. The LED device includes a LED and a plurality of tail portions electrically interconnected with the LED. The tail portions are soldered on the conductive pads of the conductive members.

The tail portions of the LED device are soldered on the conductive pads for strengthening the connection between the LED device and the printed circuit board.

Other objects, advantages and novel features of the invention will become more apparent from the following detailed description of the present embodiments when taken in conjunction with the accompanying drawings.

DETAILED DESCRIPTION OF THE INVENTION

Figure 1:
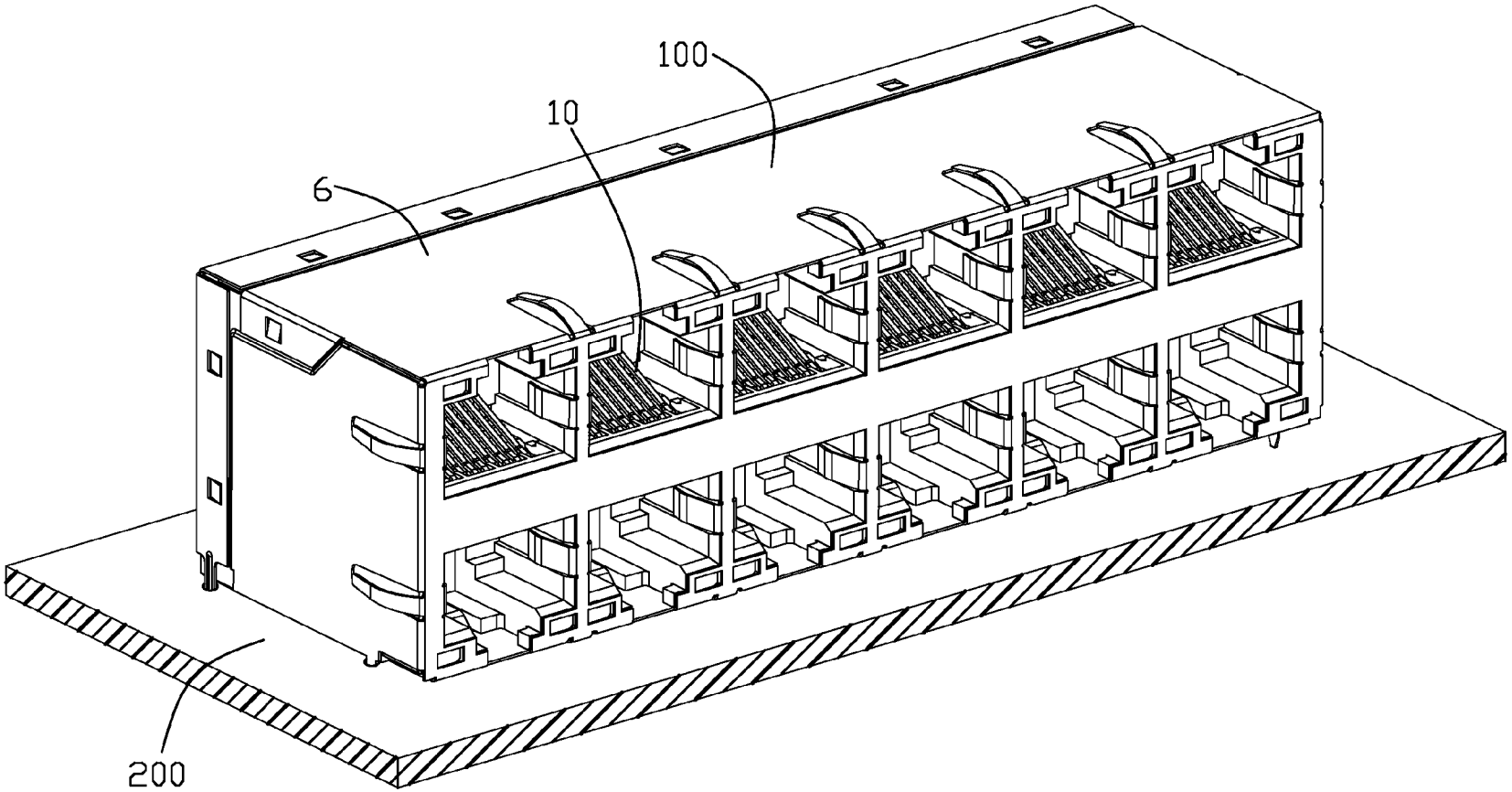
FIG. 1 is an assembled perspective view of an electrical connector assembly in accordance with the present invention.

Reference will now be made to the drawing figures to describe the present invention in detail. FIGS. 1-5 show a multiple "stacked jack" electrical connector 100 is mounted on a printed circuit board 200. The electrical connector 100 generally comprises an insulative housing 1, a plurality of LED devices 2, a plurality of connecting modules 3 and a plurality of terminal modules 5 received in the insulative housing 1, and a metallic shield 6 substantially surrounding the insulative housing 1.

Figure 2:
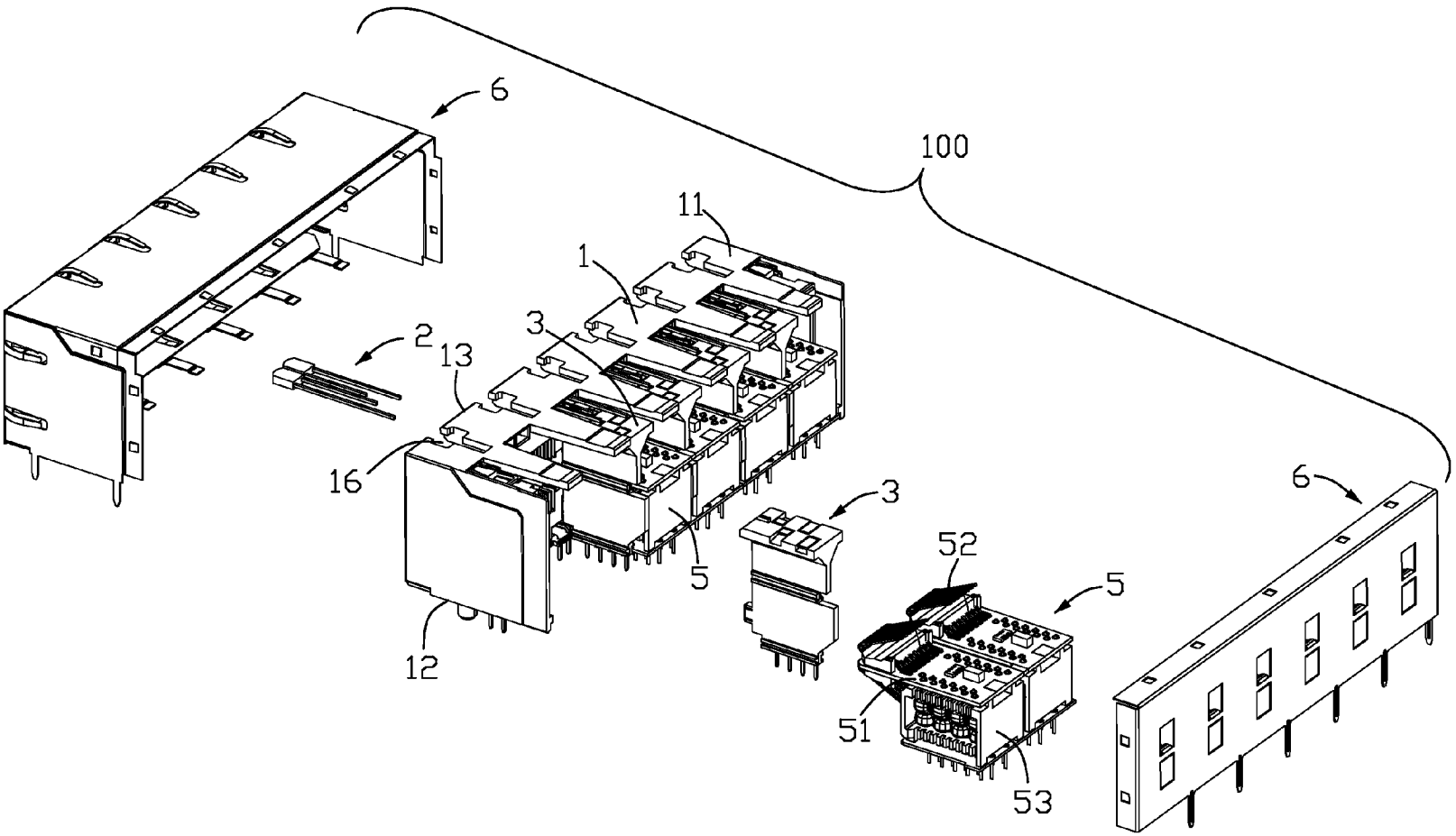
FIG. 2 is an exploded view of the electrical connector as shown in FIG. 1.
Figure 3:
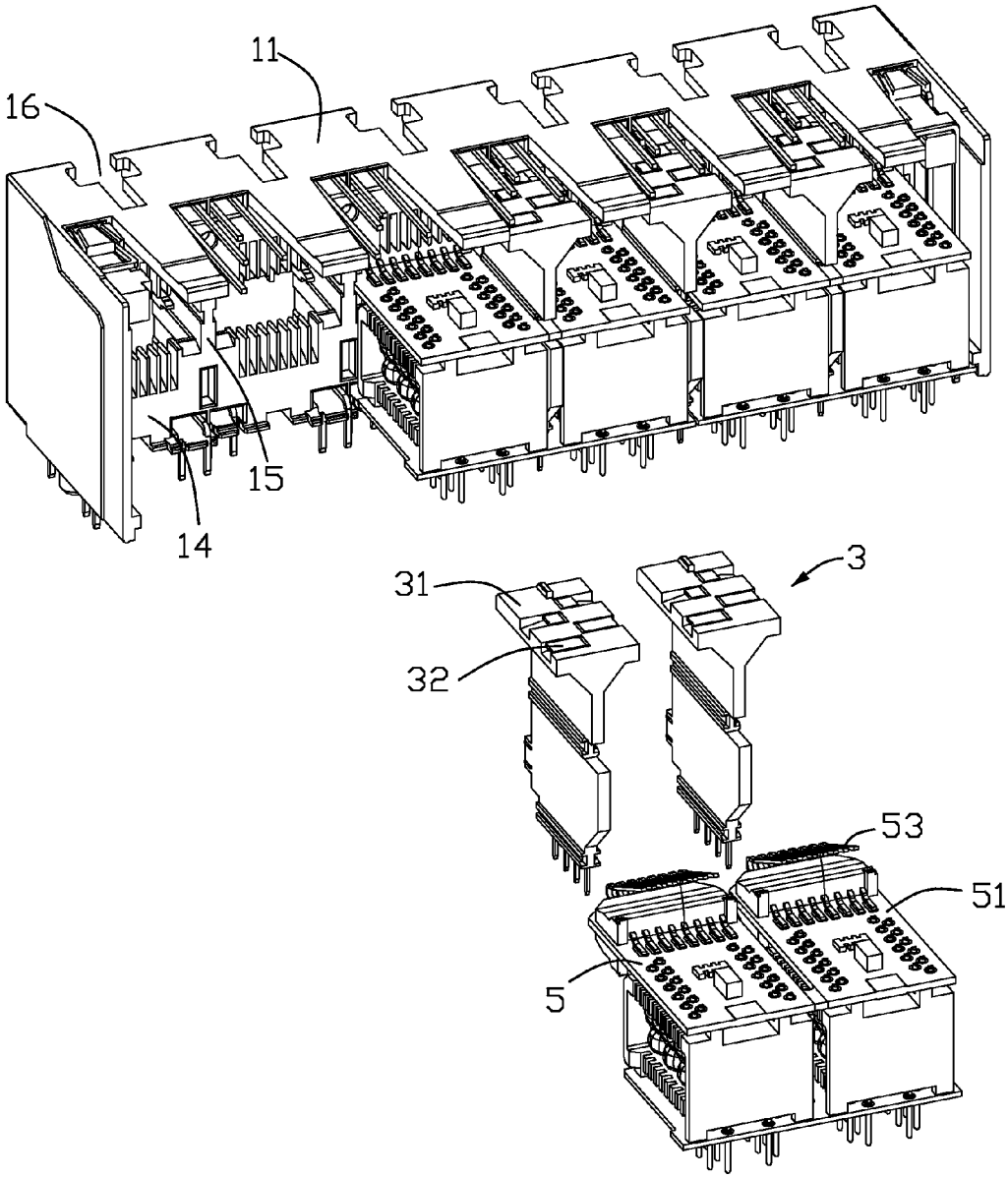
FIG. 3 is a partially exploded view of the electrical connector, with a metallic shield as shown in FIG. 2 being removed.

Referring to FIGS. 2 and 3, the insulative housing 1 includes a top wall 11, a lower wall 12, a front wall 13, a rear wall 14 and a plurality of intermediate walls 15. The insulative housing 1 includes a plurality of ports 10 defined by the walls and extending through the front wall 13. The ports 10 are configured for receiving a plurality of modular plugs (not shown). The insulative housing 1 further includes a plurality of cavities 16 defined in the top wall 11. The cavities 16 extend through the front wall 13 and the rear wall 14.

Figure 4:
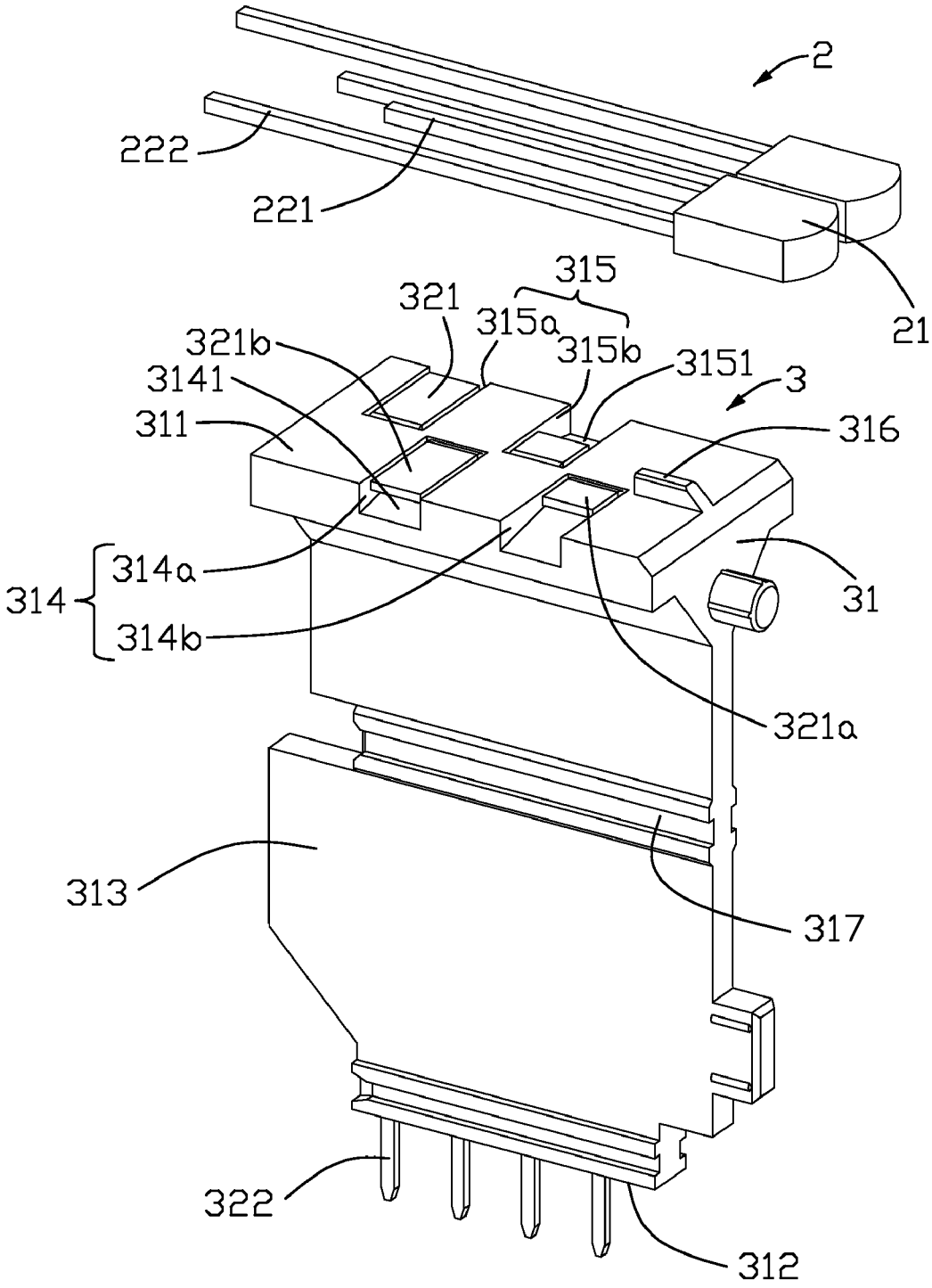
FIG. 4 is a perspective view of a plurality of LED devices and a connecting module of the electrical connector as shown in FIG. 1, when a plurality of tail portions of the LED devices have not been soldered on a plurality of conductive pads of the connecting module.
Figure 5:
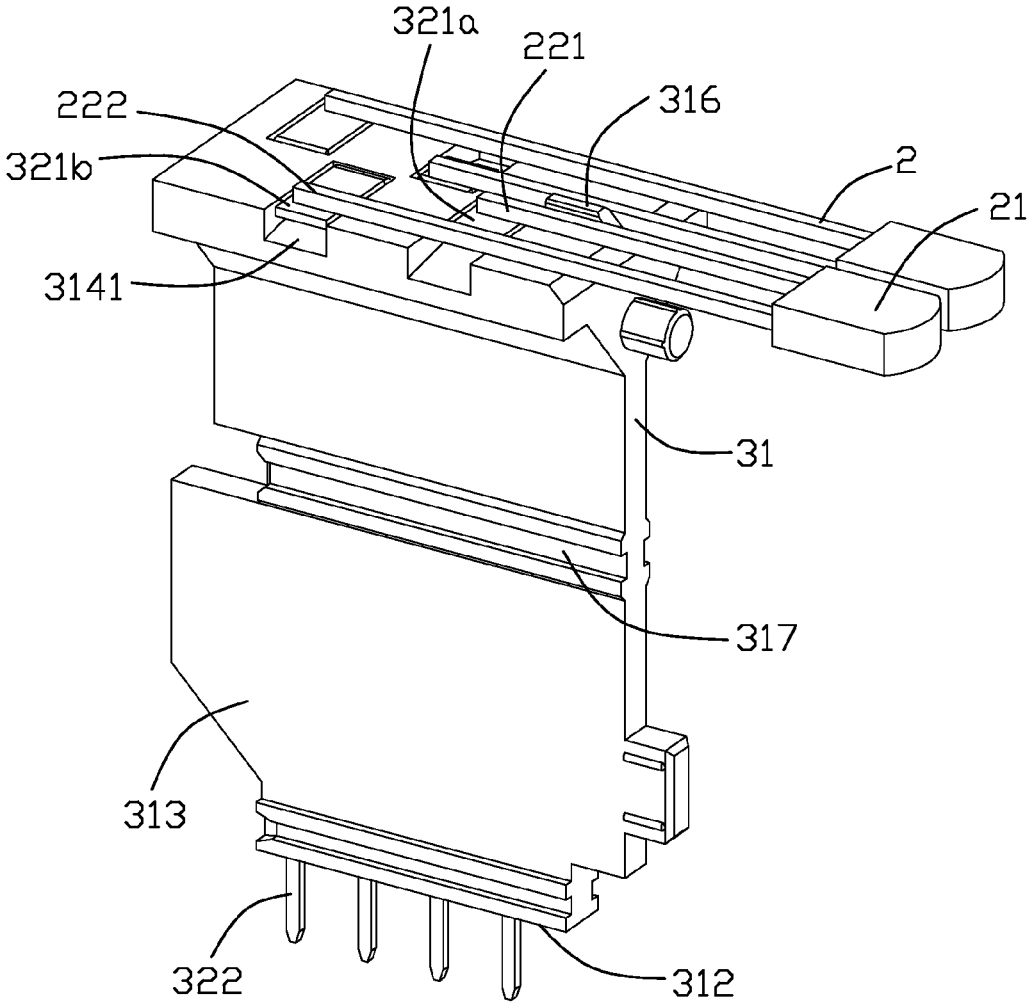
FIG. 5 is a perspective view of the LED devices and the connecting module as shown in FIG. 4, when the tail portions of the LED devices have been soldered on the conductive pads of the connecting module.

Referring to FIGS. 4 and 5, the LED devices 2 are received in the cavities 16 of the insulative housing 1. Each LED device 2 includes a LED 21, a first and second tail portions 221, 222 electrically interconnected with the LED 21. The first tail portion 221 has a length shorter than that of the second tail portion 222.

The connecting modules 3 are disposed in the insulative housing 1. Each connecting module 3 includes a carrier member 31 and a plurality of conductive members 32. The carrier member 31 includes a top surface 311, a bottom surface 312 and a pair of lateral sides 313. The carrier member 31 includes a first and second group of grooves 314, 315 defined on the top surface 311. The first group of grooves 314 is disposed adjacent to one of the pair of lateral sides 313. The second group of grooves 315 is disposed adjacent to the other lateral side 313. The first group of grooves 314 comprise at least one groove 314*a* disposed between two adjacent grooves 315*a*, 315*b* of the second group of grooves 315 along a mounting direction parallel to the lateral side 313. The second group of grooves 315 has at least one groove 315*b* disposed between two adjacent grooves 314*a*, 314*b* of the first group of grooves 314 along the mounting direction. The arrangement of the first and second group of grooves 314, 315 would reduce the space of the carrier member 31. Each groove 314, 315 has an inclined bottom surface 3141, 3151 angled to the top surface 311. The carrier member 31 has a separator 316 formed on the top surface 311 and between the first and second group of grooves 314, 315. The carrier member 31 further has a passage 317 defined on each lateral side 313, and the passage 317 parallel to the printed circuit board 200.

Each conductive member 32 has a conductive pad 321 and an electrical lead 322 interconnected with the conductive pad 321. The conductive pads 321 of the conductive members 32 are received in the first and second group of grooves 314, 315 of the carrier 31. The electrical leads 322 of the conductive members 32 are secured in the carrier member 31 and extend through the bottom surface 312 for electrically connecting with the printed circuit board 200. The conductive pads 321 in each of the first and second group of grooves 314, 315 comprise a first and second conductive pad 321*a*, 321*b*. The first conductive pad 321*a* has a length shorter than that of the second conductive pad 321*b* along a direction transverse to the lateral side 313. The first tail portion 221 of the LED device 2 is soldered on the first conductive pad 321*a* by the surface mounting technology (SMT). The second tail portion 222 is soldered on the second conductive pad 321*b* also by the SMT. The second tail portion 222 could not be connected with the first conductive pad 321*a* since the length of the first conductive pad 321*a* is shorter than that of the second conductive pad 321*b*.

When manufacture the connecting module 3, firstly, the electrical leads 322 are inserted molded in the carrier member 31 and arranged along a line parallel to the lateral side 313. Then, the conductive pads 32 are bent and inserted into the grooves 314, 315. The conductive pads 32 could be bent to a right angle with the electrical leads 322 due to the inclined bottom surfaces 3141, 3151 of the grooves 314, 315.

Referring to FIGS. 2 and 3, the terminal modules 5 are received in the ports 10 of the insulative housing 1. Each terminal module 5 comprises a daughter circuit board 51 parallel to the printed circuit board 200, a mating contact module 52 assembled at a front of the daughter circuit board 51, and a transceiver module 53 formed on the daughter circuit board 51 for electrically connecting with the daughter circuit board 51 and the printed circuit board 200. Each connecting module 3 is disposed between two adjacent terminal modules 5. The daughter circuit boards 51 engage with the passages 317 of the carrier members 31.

The tail portions 221, 222 of the LED device 2 are soldered on the conductive pads 314, 315 by SMT for strengthening the connection between the LED device 3 and the printed circuit board 200.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector mounted on a printed circuit board, the electrical connector comprising:

an insulative housing having a top wall, a bottom wall, an intermediate wall and a plurality of ports defined therebetween, a plurality of conductive members disposed therein, each conductive member comprising a conductive pad electrically connecting with the printed circuit board;

a plurality of terminal modules received in the ports of the insulative housing, each terminal module comprising a daughter circuit board parallel to the printed circuit board, a mating contact module assembled at a front of the daughter circuit board, and a transceiver module formed on the daughter circuit board for electrically connecting the daughter circuit board and the printed circuit board;

a plurality of carrier members disposed in the insulative housing, each carrier member being disposed between two adjacent terminal modules, and said conductive members being disposed in the carrier member; and a LED device received in the insulative housing, the LED device comprising a LED and a plurality of tail portions electrically interconnected with the LED, the tail portions soldered on the conductive pads of the conductive members.

2. The electrical connector as claimed in claim 1, wherein said tail portions of the LED device are soldered on the conductive pads by the surface mounting technology.

3. The electrical connector as claimed in claim 1, wherein said carrier member has a top surface, a bottom surface and a pair of lateral sides, and the carrier member has a plurality of grooves defined on the top surface, said conductive pads received in the grooves.

4. The electrical connector as claimed in claim 3, wherein each groove comprises an inclined bottom surface angled to the top surface of the carrier member.

5. The electrical connector as claimed in claim 3, wherein said carrier member has a passage defined on each lateral side, the passage parallel to the printed circuit board.

6. The electrical connector as claimed in claim 3, wherein each conductive member comprises an electrical lead interconnected with the conductive pad, the electrical lead secured in the carrier member and extending through the bottom surface for electrically connecting with the printed circuit board.

7. The electrical connector as claimed in claim 6, wherein said electrical leads of the conductive pads are insert molded in the carrier member and arranged along a line parallel to the lateral side.

8. The electrical connector as claimed in claim 3, wherein said grooves comprise a first and second group of grooves, the first group of grooves disposed adjacent to one of the pair of lateral sides, the second group of grooves disposed adjacent to the other lateral side.

9. The electrical connector as claimed in claim 8, wherein said carrier member has a separator formed on the top surface and between the first and second group of grooves.

10. The electrical connector as claimed in claim 8, wherein said first group of grooves comprise at least one groove disposed between two adjacent grooves of the second group of grooves along a mounting direction parallel to the lateral side, said second group of grooves have at least one groove disposed between two adjacent grooves of the first group of grooves along the mounting direction.

11. The electrical connector as claimed in claim 8, wherein said conductive pads in each of the first and second group of grooves comprise a first and second conductive pad, the first conductive pad having a length shorter than that of the second conductive pad along a direction transverse to the lateral side.

12. The electrical connector as claimed in claim 11, wherein said tail portions of the LED device comprise a first and second tail portions, the first tail portion having a length shorter than that of the second tail portion, and the first tail portion being soldered on the first conductive pad, the second tail portion being soldered on the second conductive pad.

13. An electrical connector comprising:

an insulative housing defining a plurality of mating ports in a front portion along a front-to-back direction;

a plurality of terminal modules assembled to the housing with a plurality of contact sections exposed in the corresponding mating port, respectively, for mating with corresponding mating plugs, and a plurality of mounting sections exposed in a rear portion of the housing for mounting to a printed circuit board; and a plurality of connecting modules alternately arranged with the terminal modules, each of said connecting modules mechanically and electrically connected to LED devices which are side by side arranged with each other in a transverse direction perpendicular to said front-to-back direction around a top portion thereof; wherein the connecting module further defines a plurality of mounting legs which are side by side arranged with one another along said front-to-back direction for mounting to the printed circuit board; wherein the LED devices are soldered upon the corresponding connecting modules, respectively.

14. The electrical connector as claimed in claim 13, wherein said terminal modules are interlocked with the corresponding neighboring connecting modules, respectively.

15. The electrical connector as claimed in claim 14, wherein the connecting modules are further retained to the housing.

16. An electrical connector mounted on a printed circuit board, the electrical connector comprising:

an insulative housing having a plurality of conductive members disposed therein, each conductive member comprising a conductive pad electrically connecting with the printed circuit board; and a LED device received in the insulative housing, the LED device comprising a LED and a plurality of tail portions electrically interconnected with the LED, the tail portions soldered on the conductive pads of the conductive members;

further comprising a carrier member disposed in the insulative housing, and said conductive members are disposed in the carrier member; wherein said carrier member has a top surface, a bottom surface and a pair of lateral sides, and the carrier member has a plurality of grooves defined on the top surface, said conductive pads received in the grooves; wherein said grooves comprise a first and second group of grooves, the first group of grooves disposed adjacent to one of the pair of lateral sides, the second group of grooves disposed adjacent to the other lateral side.

17. The electrical connector as claimed in claim 16, wherein said carrier member has a separator formed on the top surface and between the first and second group of grooves.

18. The electrical connector as claimed in claim 16, wherein said first group of grooves comprise at least one groove disposed between two adjacent grooves of the second group of grooves along a mounting direction parallel to the lateral side, said second group of grooves have at least one groove disposed between two adjacent grooves of the first group of grooves along the mounting direction.

19. The electrical connector as claimed in claim 16, wherein said conductive pads in each of the first and second group of grooves comprise a first and second conductive pad, the first conductive pad having a length shorter than that of the second conductive pad along a direction transverse to the lateral side.

20. The electrical connector as claimed in claim 19, wherein said tail portions of the LED device comprise a first and second tail portions, the first tail portion having a length shorter than that of the second tail portion, and the first tail portion being soldered on the first conductive pad, the second tail portion being soldered on the second conductive pad.

* * * * *